US009080834B1

(12) United States Patent
Williford

(10) Patent No.: US 9,080,834 B1
(45) Date of Patent: Jul. 14, 2015

(54) TACTICAL ATTACHMENT SYSTEM FOR FIREARMS

(71) Applicant: Tommy Lynn Williford, Paso Robles, CA (US)

(72) Inventor: Tommy Lynn Williford, Paso Robles, CA (US)

( * ) Notice: Subject to any disclaimer, the term of this patent is extended or adjusted under 35 U.S.C. 154(b) by 225 days.

(21) Appl. No.: 13/986,891

(22) Filed: Jun. 14, 2013

Related U.S. Application Data

(63) Continuation-in-part of application No. 13/986,170, filed on Apr. 8, 2013.

(51) Int. Cl.
*F41C 27/00* (2006.01)
*F41G 1/35* (2006.01)

(52) U.S. Cl.
CPC .. *F41C 27/00* (2013.01); *F41G 1/35* (2013.01)

(58) Field of Classification Search
CPC ..... F41A 35/00; F41C 23/00; F41C 23/16; F41C 27/00; F41C 27/16; F41C 27/18; F41G 1/35; F41G 11/001; F41G 11/002
USPC ..... 42/90, 85, 111, 114, 146, 148, 106
See application file for complete search history.

(56) References Cited

U.S. PATENT DOCUMENTS 951,657 A * 3/1910 Pedersen ..... 42/49.01
993,817 A * 5/1911 Bennett ..... 42/49.01
1,148,297 A * 7/1915 Dickey ..... 124/51.1
1,702,221 A * 2/1929 Parsons ..... 42/17
3,018,577 A * 1/1962 La Violette, Jr. ..... 42/6
3,513,581 A * 5/1970 Slater ..... 42/146
3,777,383 A * 12/1973 Haines et al. ..... 42/49.02
3,883,976 A * 5/1975 Norman et al. ..... 42/49.01
4,953,316 A * 9/1990 Litton et al. ..... 42/90
5,613,316 A * 3/1997 Hightower ..... 42/85
5,727,346 A * 3/1998 Lazzarini et al. ..... 42/146
6,565,226 B1 * 5/2003 Cummings ..... 362/110
6,722,076 B2 * 4/2004 Nielsen ..... 42/146
7,584,569 B2 * 9/2009 Kallio et al. ..... 42/117
8,418,393 B1 * 4/2013 Powers ..... 42/85
2003/0090894 A1 * 5/2003 Cummings ..... 362/110
2004/0045209 A1 * 3/2004 Nielsen ..... 42/146
2005/0188594 A1 * 9/2005 Tilby ..... 42/85
2007/0039225 A1 * 2/2007 Kallio et al. ..... 42/146
2007/0137087 A1 * 6/2007 Florea et al. ..... 42/90
2010/0277896 A1 * 11/2010 Oehlkers ..... 362/110

* cited by examiner

*Primary Examiner* — Jonathan C Weber
(74) *Attorney, Agent, or Firm* — D'Arcy H. Lorimer; Lorimer Labs

(57) ABSTRACT

A system for mounting a plurality of tactical attachments to firearms having a magazine tube is disclosed. Tactical attachments or devices such as laser illumination sights, flashlights, magazine extension tubes, and breaching tools are interchangeable and attached with a single adapter mounted to the end of a magazine ammunition tube. Adapters of varying lengths provide increased ammunition capacity. The tactical devices have a common mounting structure for mating to the adapter, which includes a optional locking ring to assure the tactical device cannot become dislodged from the adapter during firearm usage. The adapter/tactical device interface allows rapid swapping of tactical devices without the need of tools.

20 Claims, 10 Drawing Sheets

500
106
108
110
502
304a
504

501
106
110
304a
502
504
410
406
408

503
106
110
304b
504
410
406
408

505
504
502
504
304a

TACTICAL ATTACHMENT SYSTEM FOR FIREARMS

REFERENCES TO PRIOR APPLICATIONS

This application is a continuation in part of co-pending non-provisional application, Ser. No. 13/986,170 filed Apr. 8, 2013, entitled TACTICAL ATTACHMENT SYSTEM FOR FIREARMS, which is further related to provisional application, reference no. 61/639,950 filed Apr. 30, 2012, entitled SHOTGUN TACTICAL ULTRA-ILLUMINATION DEVICE OR THE ACRONYM: S.T.U.D., and claims benefit thereof. Non-provisional application Ser. No. 13/986,170 and provisional application no. 61/639,950 are hereby incorporated by reference in their entirety.

BACKGROUND OF THE INVENTION

The invention relates to the design and structure of attachments and their mounting system for firearms. More specifically, the invention relates to tactical attachments mounted to the ammunition magazine tube of long guns and shotguns.

Users of firearms often attach removable devices such as laser sights, flashlights, and other accessories to their weapon. Typically, these attachments require special brackets and mounting systems which are expensive and custom built, each "tactical" device or attachment having its own bracketing or mount. These custom mounts further require alignment with the firearm's point of aim, which can be time consuming to set up and are subject to misalignment if physically bumped during use. Some bracketing interferes with the use of the aiming sights on the weapon which can further hinder use.

If the weapon stores ammunition in a tubular style magazine, tactical attachments may be mounted to the end of the ammunition tube, replacing the stock cap employed by the manufacturer. This mounting method has the advantage of automatic alignment with the weapon's point of aim. Typically, this method has been utilized with pump style shotguns, although it may also be employed with other longs guns having tube magazines such as lever action rifles, for example.

FIG. 1 (prior art) is a side view 100 of a shotgun having an ammunition tube 106. Ammunition tube 106 and pump slide 104 are situated below the barrel 102. Ammunition spring 110 provides the force to feed ammunition (not shown) in the action of the weapon (not shown) for firing. Spring 110 is held within the ammunition tube 106 via cap 112 which is threaded onto ammunition tube 106 via threads 108.

Patent Application Publication US 2010/0277896 A1 by Oehlkers discloses an example of a flashlight threaded on to the ammunition tube of a shotgun. The device combines a flashlight with extended ammunition capacity. One weakness of this approach is that a special flashlight device must be manufactured for every make and model of shotgun or long gun, which can be expensive for owners of multiple weapons. Another weakness is that the ammunition spring 110 is exposed every time the flashlight is removed or replaced with another device, which can lead to the spring launching from the ammunition tube 106 as the attachment is removed. It may also be difficult to re-install the spring if the magazine tube is full of ammunition. This can prove to be disruptive, particularly for peace officers or military personnel who rely on rapid exchange of tactical attachments during moments of high duress. Further, a thread on device 202, such as that shown in FIG. 2, may have the activation switch 204 end up in different locations, depending on the starting position prior to threading the unit 202 on. This can be troubling for military and peace officers who require "hands off" familiarity of their weapon, and can ill afford taking their eyes from the sight picture ahead to find the flashlight on/off switch.

U.S. Pat. No. 5,727,346 to Lazzarini et. al. discloses a device for mounting a flashlight or similar device into a holder attached to (below) slide 104. This system has the disadvantage that the device is mounted to a movable part, and therefore the accuracy (particularly of a laser illumination sight) is questionable. Furthermore, tactical attachments such as door breaching tools or ammunition extension tubes are not compatible with this mounting system.

U.S. Pat. No. 6,565,226 to Cummings discloses flashlight mounting system wherein the flashlight is mounted with a portion of the ammunition tube 106. This system has the disadvantage of consuming ammunition capacity, as a significant portion of the flashlight is mounted within the ammunition tube. It also requires the use of tools for the removal of the flashlight and adapters which would not be suitable for military or police field use. It is also suitable only for the larger gauge shotgun calibers, due the outside diameter requirements of the flashlight.

These and other limitations of the prior art will become apparent to those of skill in the art upon a reading of the following descriptions and a study of the several figures of the drawing.

SUMMARY OF THE INVENTION

It is an object of the present invention to provide a system for mounting tactical attachments to a firearm having an ammunition tube and an ammunition spring mounted therein, including a tactical attachment adapter having an ammunition tube mounting end and an opposing tactical attachment mounting end, the ammunition tube mounting end removably mounted to the end of the ammunition tube of the firearm, the tactical attachment mounting end having a cavity fashioned therein, the mounting end having one or more pins extending into the cavity; and a tactical attachment having a mounting structure, the mounting structure having one or more "J" shaped slots fashioned within an outer surface, the mounting structure being inserted into the cavity fashioned within the tactical attachment adapter such that one or more pins extending into the cavity are engaged within a hook portion of the "J" shaped slots, wherein the tactical attachment adapter has a bore fashioned therein, extending from the ammunition tube mounting end to the cavity, the bore having a piston inserted therein, the piston having a first surface in contact with the outer surface of the tactical attachment mounting structure, the piston having a second opposing surface in contact with the ammunition spring.

It is another object of the present invention to provide a system for mounting tactical attachments to a firearm having an ammunition tube and an ammunition spring mounted therein, including a tactical attachment adapter having an ammunition tube mounting end and an opposing tactical attachment mounting end, the ammunition tube mounting end removably mounted to the end of the ammunition tube of the firearm, the tactical attachment mounting end having a cavity fashioned therein, the mounting end having one or more "J" shaped slots fashioned within a surface of the cavity; and a tactical attachment having a mounting structure, the mounting structure having a first portion and a second portion, the first portion of the mounting structure having one or more pins extending from an outer surface, the mounting structure being inserted into the cavity fashioned within the tactical attachment adapter such that one or more pins extending from the outer surface of the tactical attachment are engaged within a hook portion of the "J" shaped slots, the second portion of the tactical attachment mounting structure containing a locking ring engaging an external threaded surface on the tactical attachment mounting structure, the locking ring operative to provide tension between the tactical attachment and the tactical attachment adapter.

It is another object of the present invention to provide a system for mounting tactical attachments to a firearm having an ammunition tube and an ammunition spring mounted therein, including a tactical attachment adapter having an ammunition tube mounting end and an opposing tactical attachment mounting end, the ammunition tube mounting end removably mounted to the end of the ammunition tube of the firearm, the tactical attachment mounting end having a cavity fashioned therein, the mounting end having one or more "J" shaped slots fashioned within a surface of the cavity; and a tactical attachment having a mounting structure, the mounting structure having having one or more pins extending from an outer surface, the mounting structure being inserted into the cavity fashioned within the tactical attachment adapter such that one or more pins extending from the outer surface of the tactical attachment are engaged within a hook portion of one or more "J" shaped slots, wherein the tactical attachment adapter has a bore fashioned therein, extending from the ammunition tube mounting end to the cavity, the bore having a piston inserted therein, the piston having a first surface in contact with the outer surface of the tactical attachment mounting structure, the piston having a second opposing surface in contact with the ammunition spring.

These and other embodiments, features and advantages will become apparent to those of skill in the art upon a reading of the following descriptions and a study of the several figures of the drawing.

BRIEF DESCRIPTION OF THE DRAWINGS

Several example embodiments will now be described with reference to the drawings, wherein like components are provided with like reference numerals. The example embodiments are intended to illustrate, but not to limit, the invention. The drawings include the following figures.

DETAILED DESCRIPTION OF THE PREFERRED EMBODIMENTS

Example embodiments of the subsequently disclosed present invention provide significant improvements over the heretofore described prior art. The present invention discloses a system for a wide variety of tactical attachments that can be added to long guns with tube magazines or shotguns with tube magazines. The system provides a standardized mounting geometry for all tactical attachments that are mounted to custom adapters designed for each individual firearm. The adapters provide fast insert and lock mechanisms with an optional locking collar to prevent loosening of the tactical attachment. In some example embodiments, the locking ring is omitted. In other example embodiments, the magazine spring is fully contained by the adapter, even with the tactical attachment removed, so there is no possibility of loosing the spring or having to re-insert the spring during the swap of different attachments. A wide variety of tactical attachments are accommodated with this system, including (but not limited to) flashlights, laser illumination sights, door breaching tools, and magazine capacity extension tubes.

Figure 1:
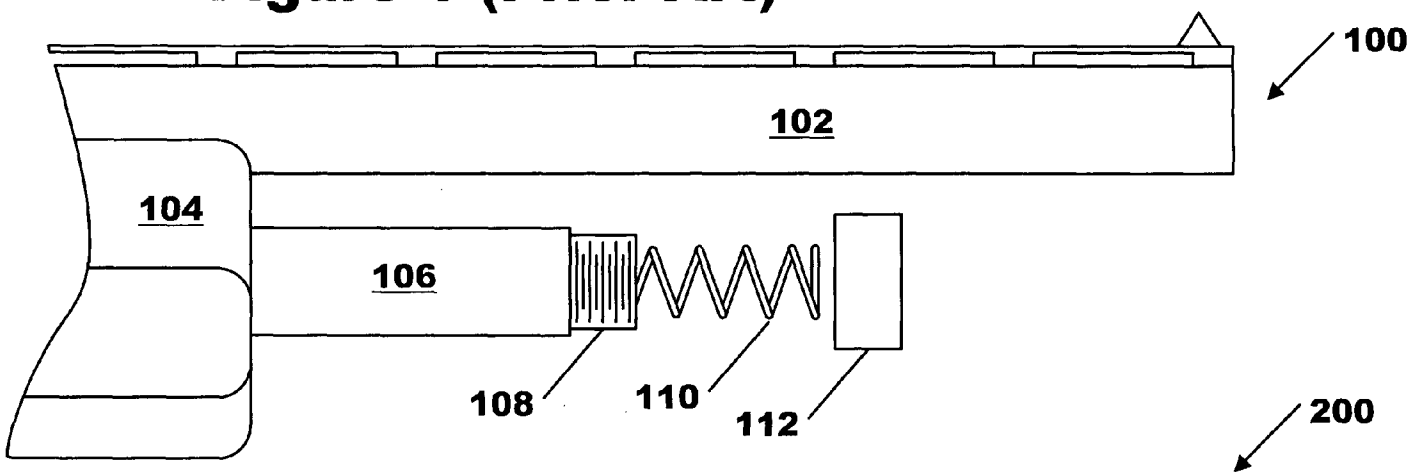
Figure 1 (Prior Art)
FIG. 1 (Prior Art) is a side view of a shotgun having an ammunition tube.
Figure 2:
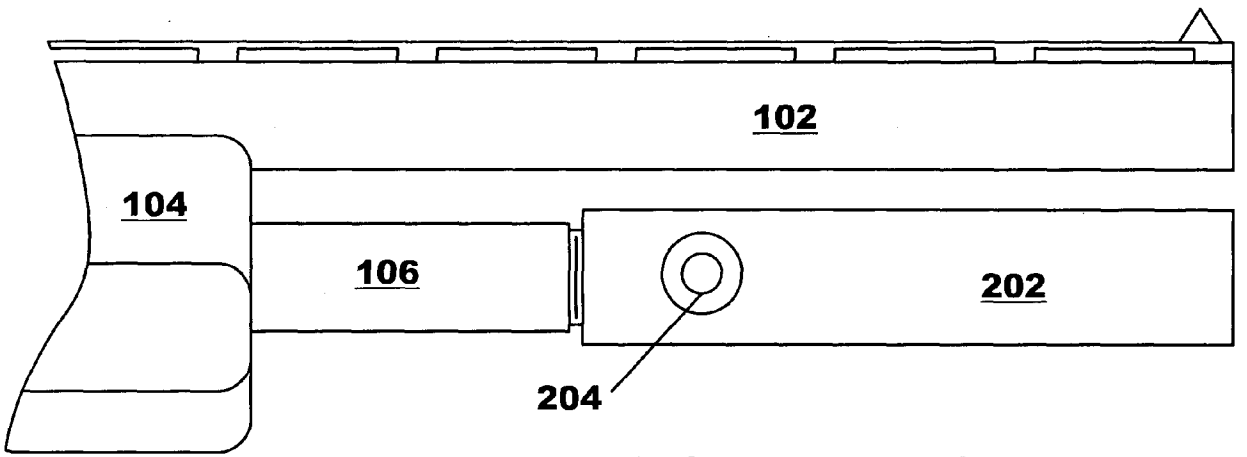
Figure 2 (Prior Art)
FIG. 2 (Prior Art) is a side view of a shotgun having a flashlight threaded on to the end of a magazine tube.
Figure 3:
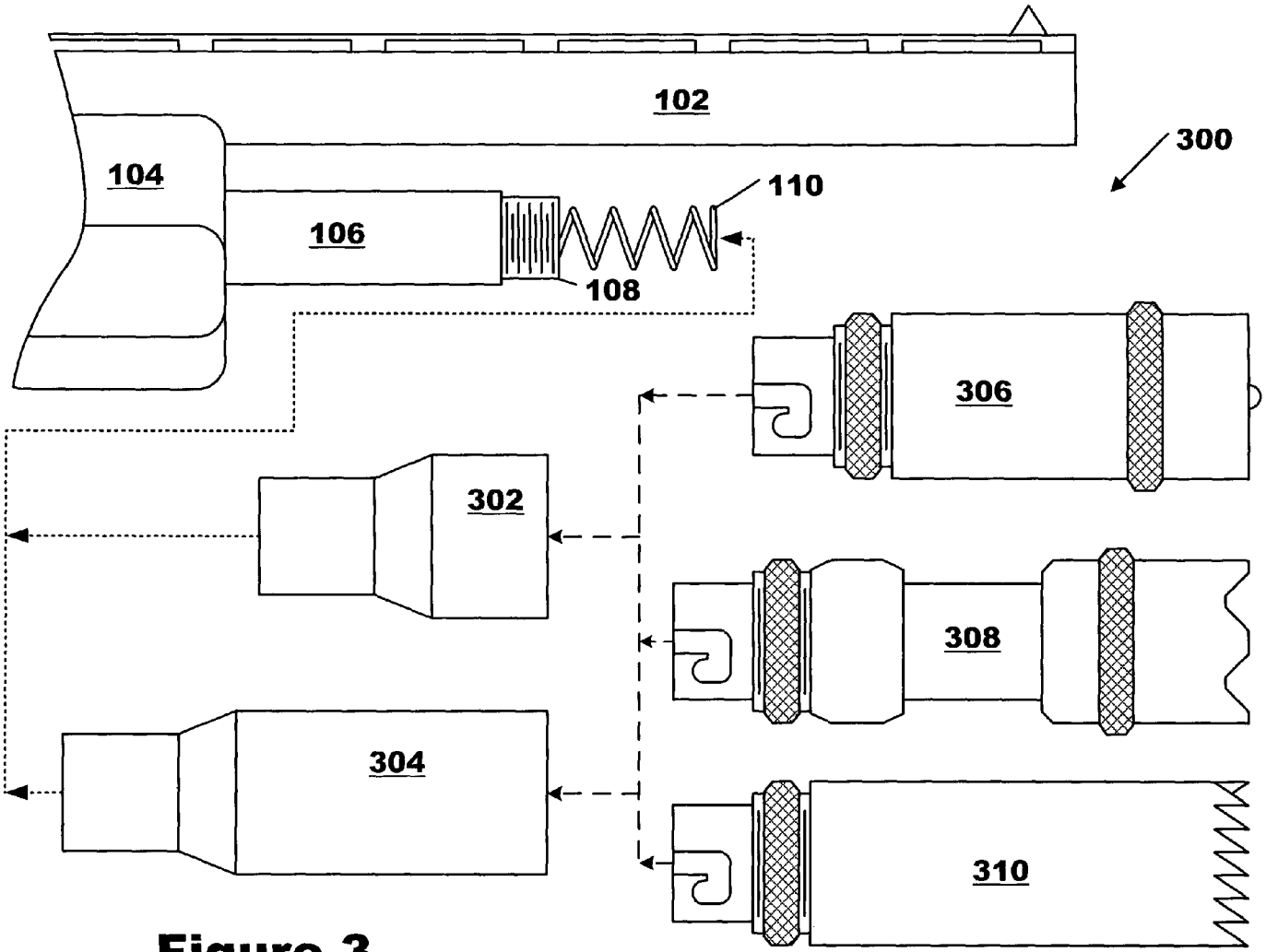
FIG. 3 is a profile side view of a tactical attachment system, in accordance with example embodiments of the present invention.

FIG. 3 is a profile side view 300 of a tactical attachment system, in accordance with example embodiments of the present invention. As an example, a pump style shotgun (as shown in FIG. 1) is used to illustrate the application of embodiments of the present invention, although it is understood that other suitable weapons having tube ammunition magazines may also be utilized, as can be appreciated by those skilled in the art. Adapters 302, 304 are threaded on to ammunition tube 106 via threads 108. The differences between adapters 302 and 304 are discussed further below. Tactical attachments laser illumination sight 306, flashlight 308, and breaching tool 310 all have a common mounting geometry, which is designed to interchangeably fit the receiving portion of adapters 302, 304. In the field or during use of the firearm, interchange of any of the tactical attachments 306, 308, or 310 can be accomplished without tools or the removal of adapter 302 (or 304). This flexibility allows the owner of the firearm to purchase and stock different adapters designed for individual weapons, but use a common selection of tactical attachments for all firearms. Significant cost savings can be realized, particularly for military organizations or large law enforcement departments, as the purchase of a large number of tactical attachments designed for individual weapons is no longer required.

Figure 4A:
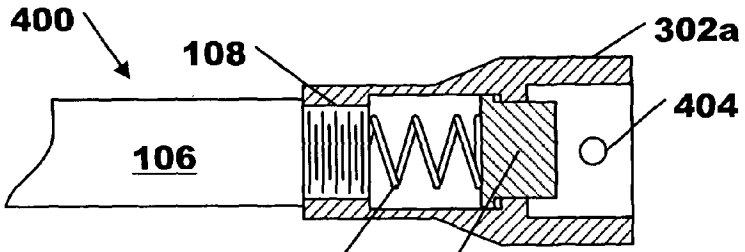
FIG. 4*a* is a partial cross section view of a tactical attachment adapter mounted on a magazine tube, in accordance with an example embodiment of the present invention.

FIGS. 4*a*-4*d* disclose details of adapter 302. FIG. 4*a* is a partial cross section view 400 of a tactical attachment adapter 302*a* mounted on a shotgun magazine tube 106, in accordance with an example embodiment of the present invention. In this example version 302*a* of adapter 302, ammunition spring 110 is contained by piston 402, which provides containment of the spring 110 once the adapter 302*a* is threaded onto the magazine tube 106. Piston 402 is freely mounted within the bore of adapter 302*a*, allowing the spring force to be transmitted to any tactical attachment coupled to the adapter (see FIG. 4*b*). Adapter 302*a* has pins 404 designed to engage fabricated slots in the mounting adapter portion of a tactical attachment (see also FIG. 4*b*). Adapter 302*a* is designed to be permanently mounted to the ammunition tube 106, serving the purpose of cap 112, allowing full functionality of the weapon, with or without tactical attachments connected.

Figure 4B:
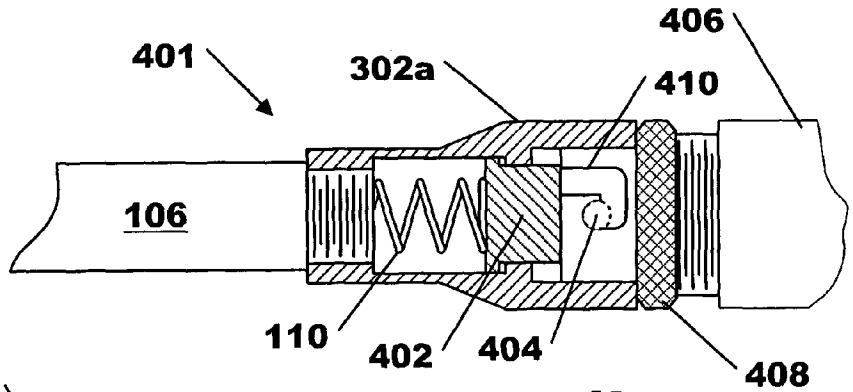
FIG. 4*b* is a partial cross section view of a tactical attachment adapter mounted on a magazine tube, and mounted to a typical tactical attachment, in accordance with an example embodiment of the present invention.

FIG. 4*b* is a partial cross section view 401 of a tactical attachment adapter 302*a* mounted on a magazine tube 106, mounted to an example tactical attachment mating structure 406, in accordance with an example embodiment of the present invention. The mating portion of a typical example tactical attachment 406 has a fabricated slot 410 designed to engage pins 404 of adapter 302*a*. Slot 410 is generally fabricated in the shape of a squared off "J", with an entrance section (the leg of the "J") and a re-entrant pin locking section (the "hook" on the "J"). When mating a tactical attachment 406 to the adapter 302*a*, the tactical attachment 406 is oriented so the pins 404 engage the entrance section of slot(s) 410. The tactical attachment 406 is then pushed in to the mounting cavity of adapter 320*a* until the rear mounting surface of the tactical attachment 406 contacts piston 402. Further insertion of tactical attachment 406 compresses spring 110 via rearward movement of piston 402, until pins 404 contact the base of the "J". Tactical attachment 406 is then rotated until pins 404 are aligned with the re-entrant pin locking section, then released. The slight forward motion of the tactical attachment 406 is aided by compressed spring 110 and piston 402 until pins 404 are locked in the hook portion of slot 410. Locking collar 408 is back threaded against the front face of adapter 302 once pins 404 are properly captured by the re-entrant geometry of slot 410. Optionally, locking collar 408 may be omitted for some tactical attachments.

The aforementioned discussion describes an example embodiment whereby pins are mounted in the tactical attachment adapter which engage slots machined in each tactical attachment. As can be appreciated by those skilled in the art, an example embodiment wherein the pins are mounted to the outer surface of each tactical attachment and the slots machined within the inner surface of the tactical attachment adapter may also be realized (not shown).

Figure 4C:
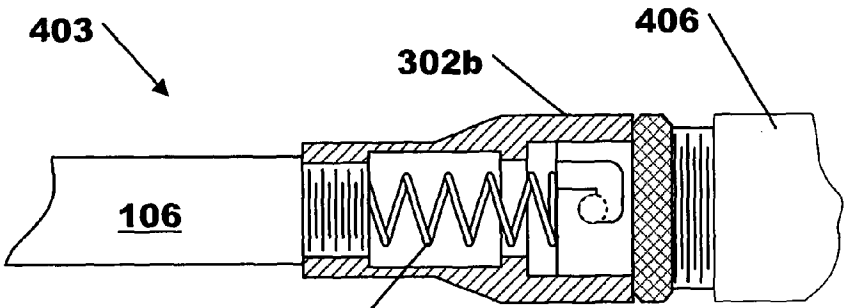
FIG. 4*c* is a partial cross section view of a "bore through" version of the tactical attachment adapter, in accordance with an example embodiment of the present invention.
Figure 4D:
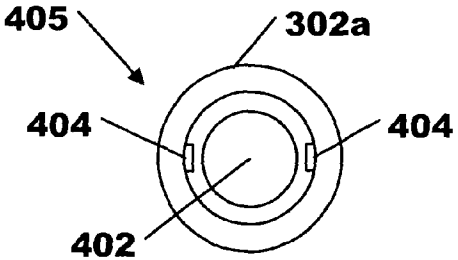
FIG. 4*d* is an end view of the tactical attachment adapter of FIG. 4*a*, in accordance with an example embodiment of the present invention.

FIG. 4*c* is a partial cross section view 403 of a "bore through" version 302*b* of the tactical attachment adapter, in accordance with an example embodiment of the present invention. In this example version, piston 402 is removed, allowing spring 110 to be directly engaged against the rear mounting surface of tactical attachment 406. This example embodiment is useful for extending magazine ammunition capacity, but has the potential disadvantage of exposing the open end of the spring while changing tactical attachments. FIG. 4*d* is an end view 405 of the tactical attachment adapter 302*a* of FIG. 4*a*, in accordance with an example embodiment of the present invention. In this view the two diametrically opposed engagement pins 404 are indicated, which mate with corresponding diametrically opposed fabricated slots on the coupling portion of the tactical attachments 406 (not shown). In the example embodiment of FIGS. 4*a*-4*d*, two engagement pins 404 are provided on the adapter. However, as can be appreciated by those skilled in the art, only one pin is essential for operation. Likewise, only a single slot 410 required on each tactical attachment, although having two slots diametrically opposed aids in rapid engagement of the attachments as there are two possible engagement positions, as opposed to only one.

Figures 5A, 5B, 5C, 5D:
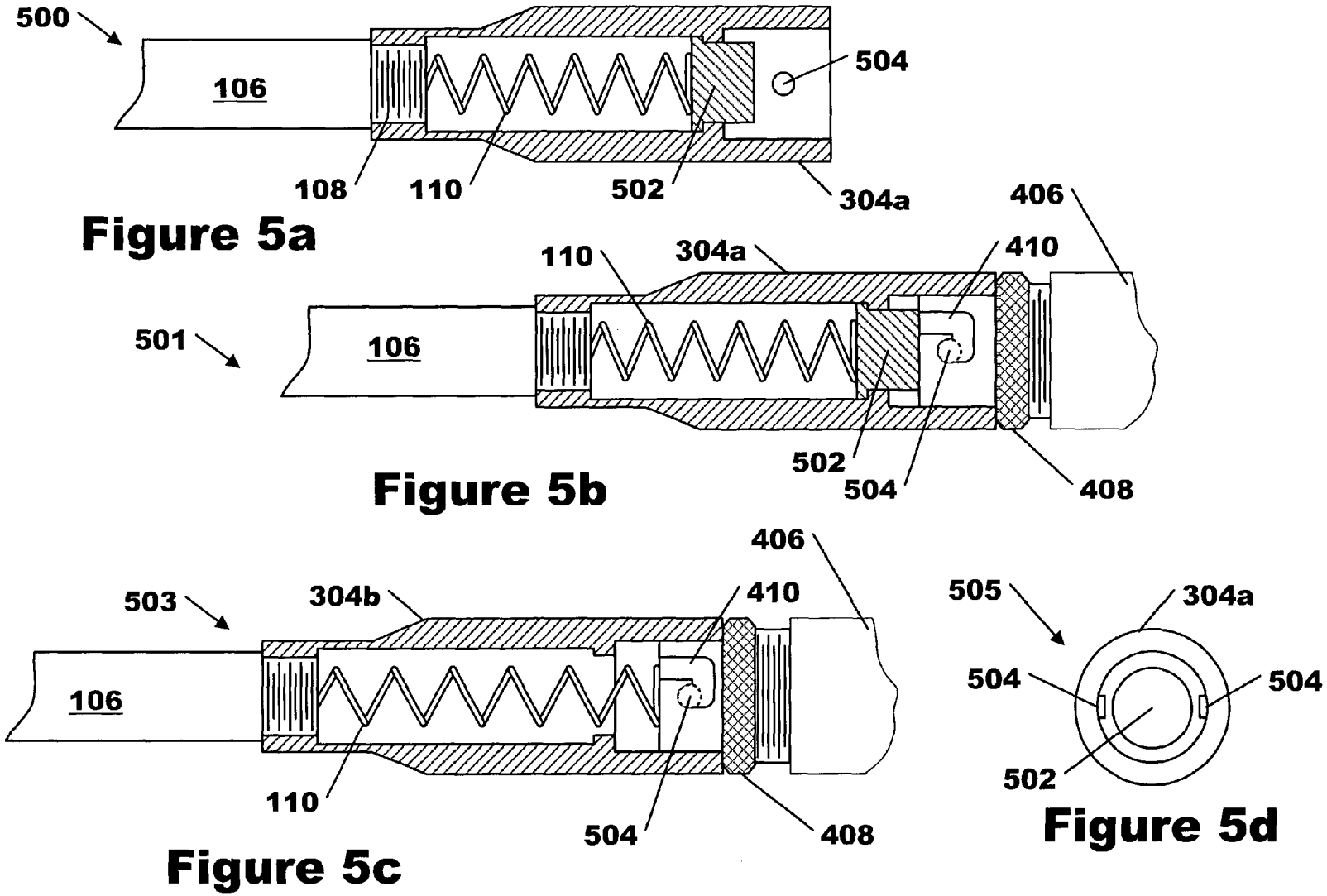
FIG. 5*a* is a partial cross section view of an extended length tactical attachment adapter mounted on a magazine tube, in accordance with an example embodiment of the present invention.
FIG. 5*b* is a partial cross section view of an extended length tactical attachment adapter mounted on a magazine tube, and mounted to a typical tactical attachment, in accordance with an example embodiment of the present invention.
FIG. 5*c* is a partial cross section view of a "bore through" version of the extended length tactical attachment adapter, in accordance with an example embodiment of the present invention.
FIG. 5*d* is an end view of the extended length tactical attachment adapter of FIG. 5*a*, in accordance with an example embodiment of the present invention.

FIGS. 5*a*-5*d* disclose details of adapter 304. FIG. 5*a* is a partial cross section view 500 of an extended length tactical attachment adapter 304 mounted on a magazine tube 106, in accordance with an example embodiment of the present invention. The difference between adapters 302 and 304 is that adapter 304 allows for further expansion of the ammunition spring 110, by extending the dimension between the end of the ammunition tube 106 and the rear of piston 502, over that provided by adapter 302. This extended length allows for more ammunition to be stored within the ammunition tube. Adapter 304*a* provides for extended ammunition capacity without the need for separate ammunition tubes (which would prohibit the use of other tactical attachments) or a bore through adapter (which can make changing tactical attachments more difficult due to the exposed magazine spring). Piston 502 and pins 504 serve the same purpose as previously described for piston 402 and pins 404 in FIGS. 4*a*-4*d*.

FIG. 5*b* is a partial cross section view 501 of an extended length tactical attachment adapter 304*a* mounted on a magazine tube 106, mounted to an example tactical attachment mating structure 406, in accordance with an example embodiment of the present invention. FIG. 5*c* is a partial cross section view 503 of a "bore through" version 304*b* of the extended length tactical attachment adapter, in accordance with an example embodiment of the present invention. FIG. 5*d* is an end view 505 of the extended length tactical attachment adapter 304*a* of FIG. 5*a*, in accordance with an example embodiment of the present invention.

Figure 6:
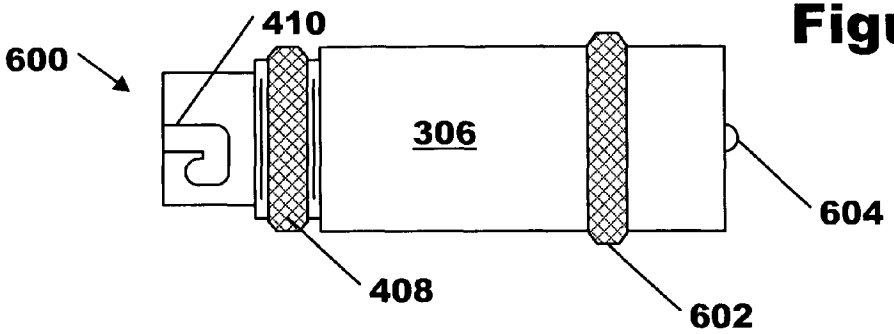
FIG. 6 is a side view of a laser sight tactical attachment, in accordance with an example embodiment of the present invention.

FIG. 6 is a side view 600 of a laser illumination sight tactical attachment 306, in accordance with an example embodiment of the present invention. This sight produces a narrow beam of visible red or infrared light, projecting an illuminated "dot" at the intended aim point of the weapon it's mounted on. Typically, the light source is a solid state laser diode 604. To be used effectively, the laser illumination sight 306 must be mounted securely on the weapon, and must remain in alignment during handling and recoil after discharge. Mounting the laser sight coaxial with the ammunition tube assures alignment with the sight axis of the firearm. The slight displacement from the actual axis of the barrel is a minor issue when used with shotguns, and can be easily compensated for on a long gun. The mating end of laser sight 306 has the fabricated slot 410 required for compatible mounting with pins 404,504 in adapter 302 or 304. Knurled ring 408 is back threaded against the adapter body once the pins 404,504 are engaged within slot 410, holding the laser sight 306 firmly on the weapon. Optionally, ring 408 may be omitted without loss of functionality. Turning the laser on and off is accomplished with a rotary actuated switch 602. This switch provides tactile feedback with detents to confirm the "on" status of the laser. In one example embodiment, the laser illumination sight 306 is powered with batteries that are contained within the enclosure (not shown). As would be evident to those skilled in the art, the laser illumination sight can be used whether mounted to a tactical attachment adapter or not.

Figure 7:
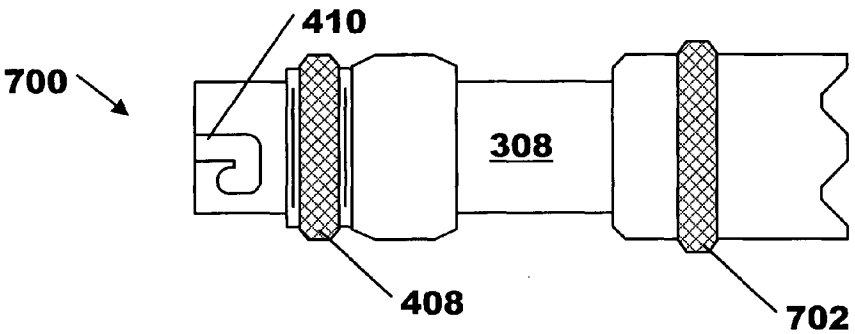
FIG. 7 is a side view of a flashlight tactical attachment, in accordance with an example embodiment of the present invention.

FIG. 7 is a side view 700 of a flashlight tactical attachment 308, in accordance with an example embodiment of the present invention. Flashlight 306 is equipped with the same mounting structure as shown for the laser illumination sight 306. Flashlight 306 may use LEDs (either visible or infrared) or incandescent bulbs to provide illumination. A rotary actuated switch 702 is also provided on the flashlight, which allows the operator to operate the flashlight without removing their eyes from the sight picture ahead of the weapon. In one example embodiment, the flashlight 308 is powered with batteries that are contained within the enclosure (not shown). As would be evident to those skilled in the art, the flashlight can be used whether mounted to a tactical attachment adapter or not.

Figure 8:
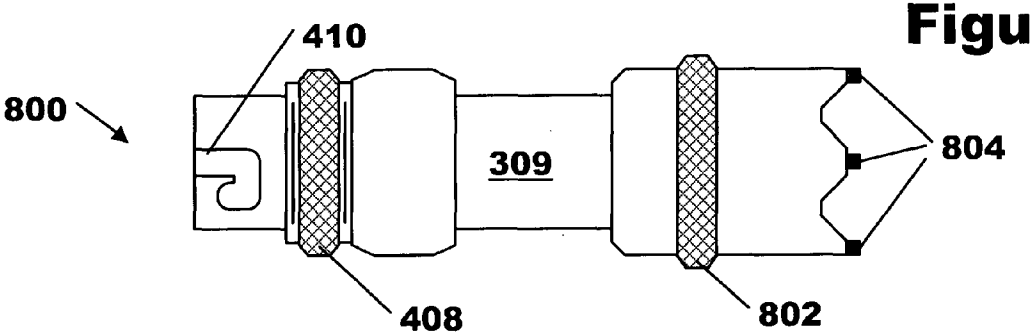
FIG. 8 is a side view of a flashlight tactical attachment, having stun gun electrodes, in accordance with an example embodiment of the present invention.

FIG. 8 is a side view 800 of a flashlight tactical attachment 309, having stun gun electrodes 804, in accordance with an example embodiment of the present invention. The built in stun electrodes provide a non-lethal option for disabling subjects. This is accomplished by providing a very high voltage, low current electrical discharge at electrodes 804. Rotary switch 802 provides control of both lighting and stun functions. In one example embodiment, the flashlight 309 is powered with batteries that are contained within the enclosure (not shown). As would be evident to those skilled in the art, the flashlight and stun functions can be used whether mounted to a tactical attachment adapter or not.

Figure 9A:
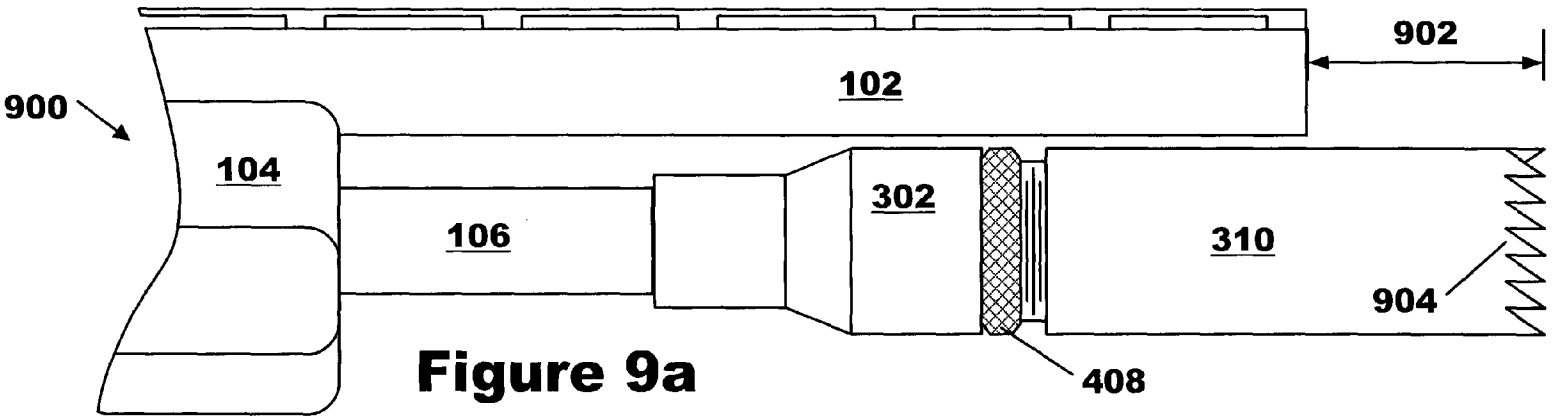
FIG. 9*a* is a side view of a shotgun having a tactical attachment adapter and a breaching tool tactical attachment mounted, in accordance with an example embodiment of the present invention.

FIGS. 9*a,b,c* disclose details of an example breaching attachment of the present invention. A breaching tool is typically an extension placed at the muzzle end of shotguns, with a saw-toothed end protruding beyond the end of the muzzle. The jagged edge is placed firmly against a surface and the shotgun is discharged. This tool is primarily used by military and law enforcement personnel to blow out locks and door hinges to allow forced entry to buildings and enclosed rooms. FIG. 9*a* is a side view 900 of a shotgun having a tactical attachment adapter 302 and a breaching tool tactical attachment 310 mounted, in accordance with an example embodiment of the present invention. Breaching tool 310 is generally cylindrically shaped, having a jagged toothed end structure, which must protrude beyond the end of the barrel 102 by a distance 902. The teeth 904 fashioned into the end of breaching tool 310 are designed to firmly dig into the surface close to where the projectiles from the firearm will be discharged, to hold the muzzle firmly in place during discharge, and focus the destructive force. Use of the breaching tool requires firm mounting to the shotgun which is aided by locking ring 408, particularly during discharge and recoil of large 10 and 12 gauge shotguns.

Figure 9B:
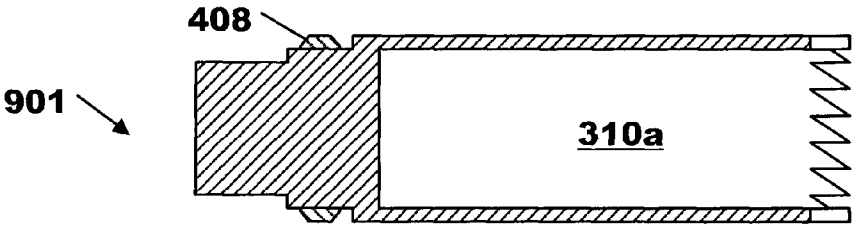
FIG. 9*b* is a cross section view of a breaching tactical attachment, in accordance with an example embodiment of the present invention.

FIG. 9*b* is a cross section view 901 of a breaching tactical attachment 310*a*, in accordance with an example embodiment of the present invention. This embodiment provides for the standard breaching tactical attachment. Note that this breaching attachment 310*a* can be rapidly exchanged with any of the foregoing tactical attachments without worry of the magazine spring being dislodged during the exchange, when used with adapters 302*a* or 304*a*. Rapid exchange with for example, the flashlight 308, can be useful to military or law enforcement personnel who, subsequent to breaching doors, must proceed into darkened rooms.

Figure 9C:
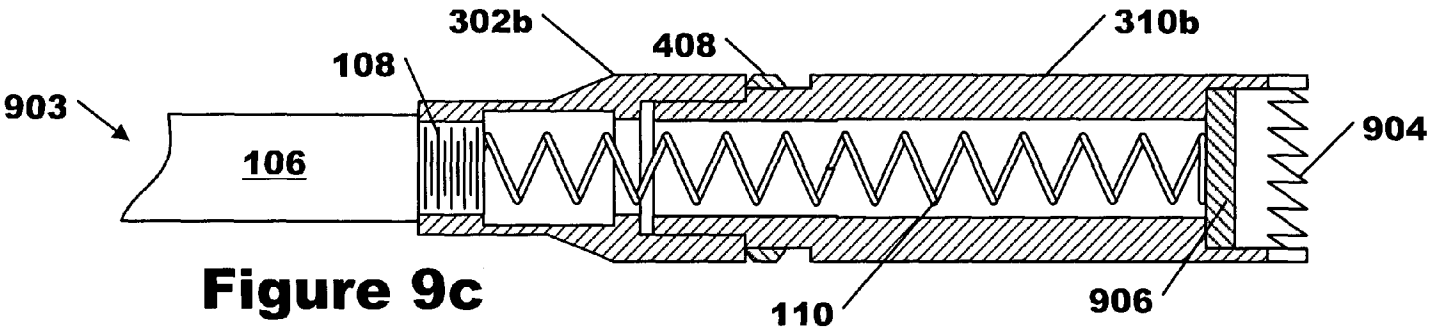
FIG. 9*c* is a partial cross section view of a "bore through" version of a breaching tactical attachment, in accordance with an example embodiment of the present invention.

FIG. 9*c* is a partial cross section view 903 of a "bore through" version of a breaching tactical attachment 310*b*, in accordance with an example embodiment of the present invention. The bore through version 310*b* provides for increased magazine capacity by allowing the magazine spring 110 to extend the majority of the length of the breaching tool. A shallow plug 906 is inserted from the toothed end of the breaching attachment to provide a stop for spring 110.

Figure 10A:
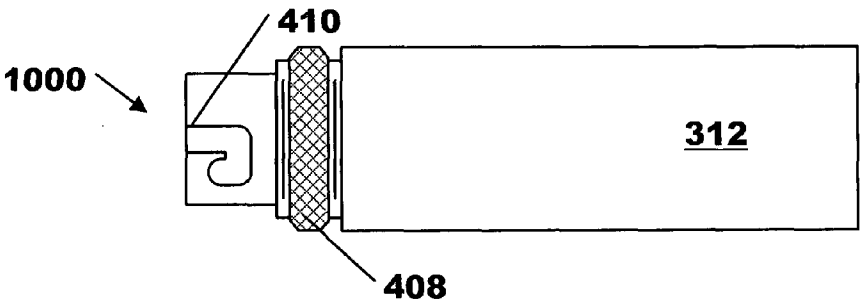
FIG. 10*a* is a side view of a magazine capacity extension tube tactical attachment, in accordance with an example embodiment of the present invention.
Figure 10B:
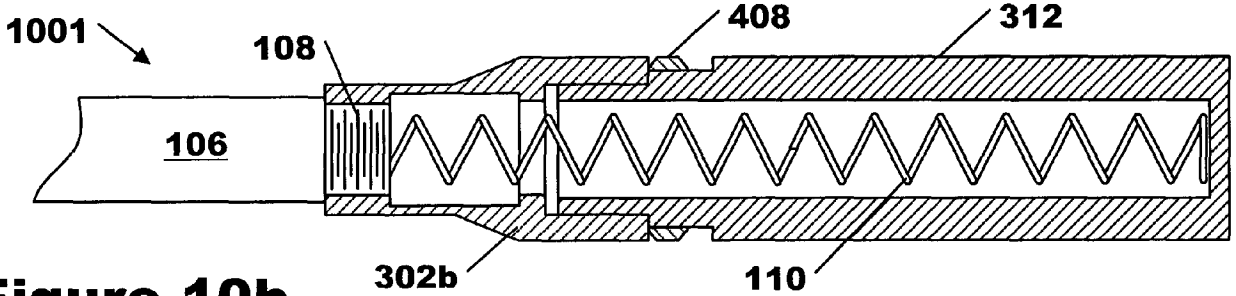
FIG. 10*b* is a partial cross section view of a magazine capacity extension tube tactical attachment, in accordance with an example embodiment of the present invention.

FIG. 10*a* is a side view 1000 of a magazine capacity extension tube tactical attachment 312, in accordance with an example embodiment of the present invention. The magazine extension tube provides increased ammunition capacity by extending the volume of the ammunition tube 106. A cross section view 1001 is shown in FIG. 10*b*. The magazine capacity extension tube must be used with bore through adapters to obtain an increase in ammunition capacity, so swapping with other tactical attachments requires the compression of the magazine spring during the exchange.

Figure 11:
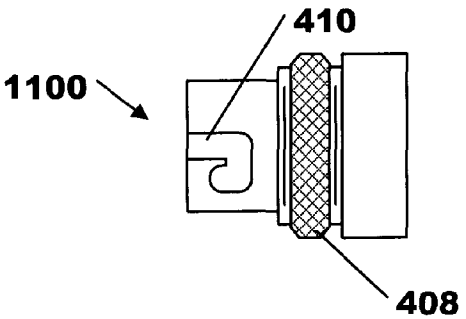
FIG. 11 is a side view of a tactical attachment cap, in accordance with an example embodiment of the present invention.

FIG. 11 is a side view 1100 of a tactical attachment cap, in accordance with an example embodiment of the present invention. The cap may be useful for enclosing the open end of adapters 302*a* and 304*a* when no tactical attachments are mounted, to prevent the contamination of the piston mechanism with dirt and debris. The cap is required to seal bore through type adapters and provide an engagement surface for the magazine spring, when no tactical attachments are mounted.

Figure 12:
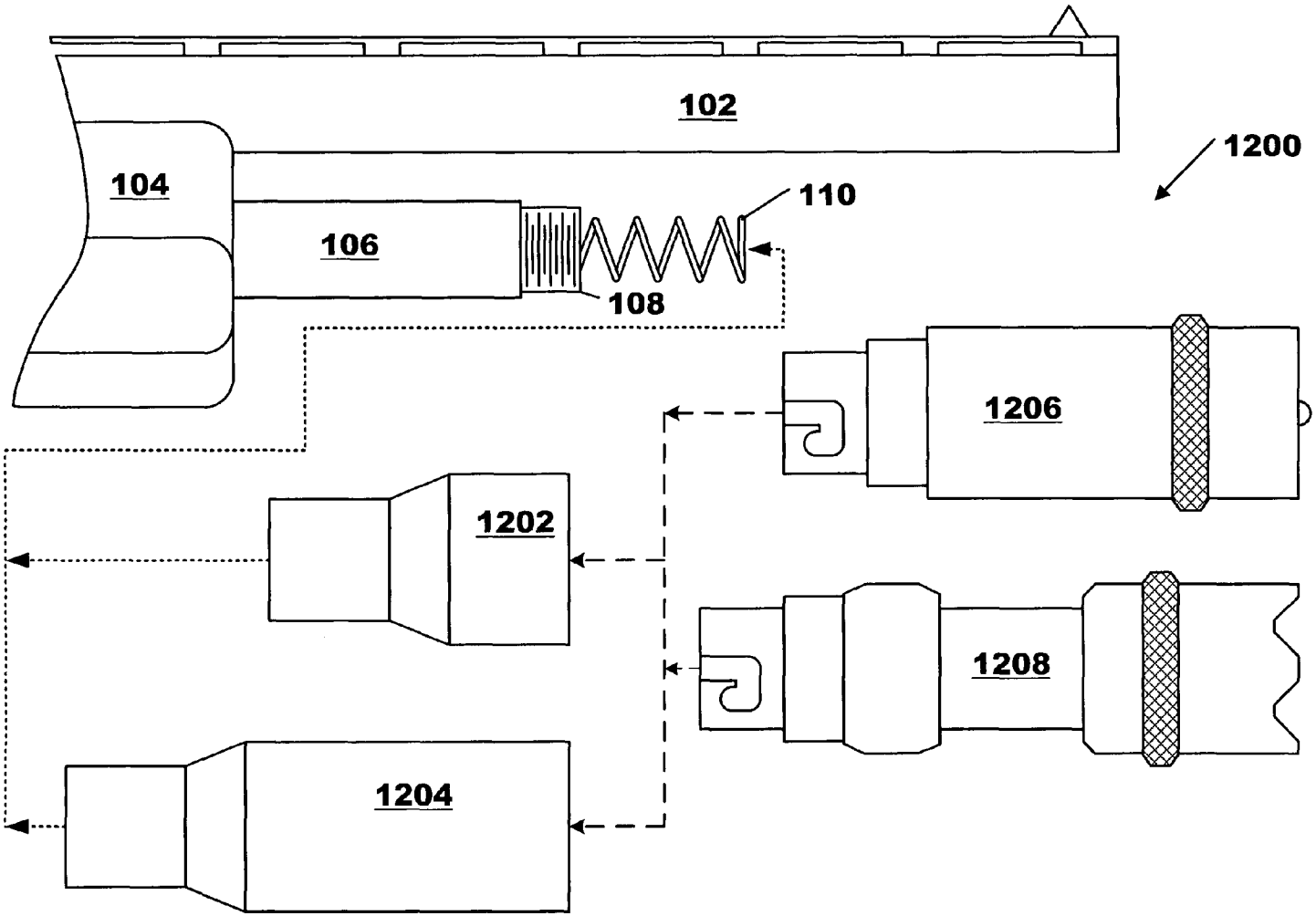
FIG. 12 is a profile side view of a tactical attachment system without locking rings, in accordance with example embodiments of the present invention.
Figure 13A:
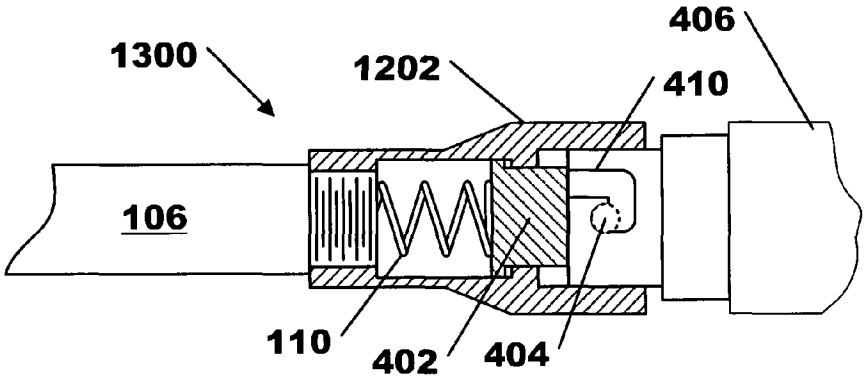
FIG. 13*a* is a partial cross section view of a tactical attachment adapter mounted on a magazine tube, and mounted to a tactical attachment without locking ring, in accordance with an example embodiment of the present invention.
Figure 13B:
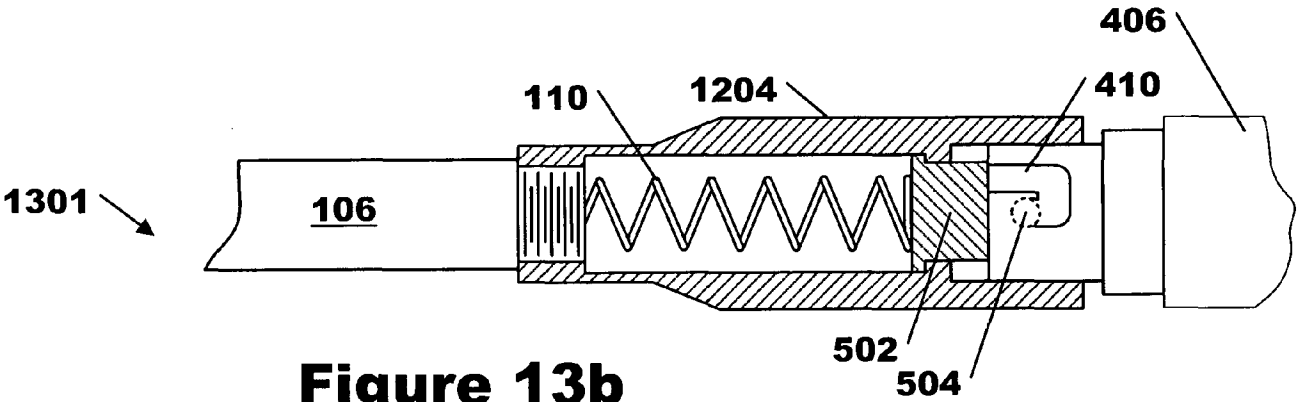
FIG. 13*b* is a partial cross section view of an extended length tactical attachment adapter mounted on a magazine tube, and mounted to a typical tactical attachment without locking ring, in accordance with an example embodiment of the present invention.

FIG. 12 is a profile side view 1200 of a tactical attachment system without locking rings, in accordance with example embodiments of the present invention. Adapters 1202 and 1204 are basically the same as adapters of FIGS. 4*a* and 5*a*, as they are designed to be used with tactical adapters with or without locking rings. While locking rings 408 are useful for assuring a tactical attachment will not come off its adapter, a number of tactical attachments can be used without the locking ring, particularly if the magazine spring 110 is stiff enough to provide suitable force against piston 402. Not having a locking ring may also speed up the removal and re-attachment of tactical adapters, such as laser sight 1206 and flashlight 1208.

Figure 14:
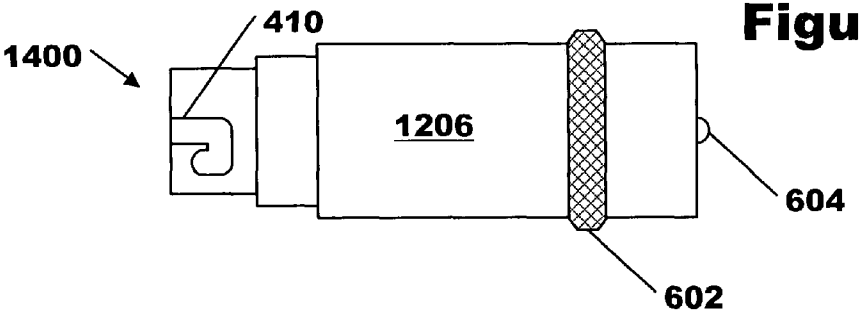
FIG. 14 is a side view of a laser sight tactical attachment without locking ring, in accordance with an example embodiment of the present invention.
Figure 15:
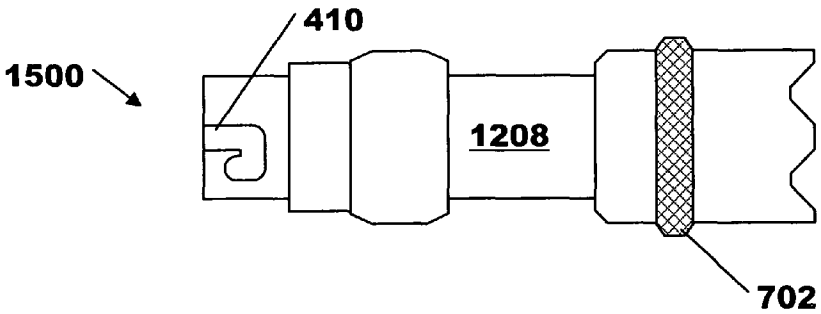
FIG. 15 is a side view of a flashlight tactical attachment without locking ring, in accordance with an example embodiment of the present invention.
Figure 16:
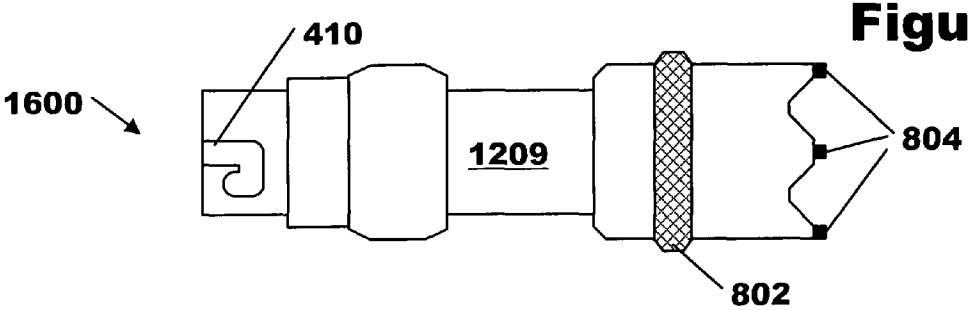
FIG. 16 is a side view of a flashlight tactical attachment without locking ring, having stun gun electrodes, in accordance with an example embodiment of the present invention.

FIG. 14 is a side view 1400 of a laser sight tactical attachment 1206 without locking ring, in accordance with an example embodiment of the present invention;

FIG. 15 is a side view 1500 of a flashlight tactical attachment 1208 without locking ring, in accordance with an example embodiment of the present invention; and FIG. 16 is a side view 1600 of a flashlight tactical attachment 1209 without locking ring, having stun gun electrodes, in accordance with an example embodiment of the present invention.

Although various embodiments have been described using specific terms and devices, such description is for illustrative purposes only. The words used are words of description rather than of limitation. It is to be understood that changes and variations may be made by those of ordinary skill in the art without departing from the spirit or the scope of various inventions supported by the written disclosure and the drawings. In addition, it should be understood that aspects of various other embodiments may be interchanged either in whole or in part. It is therefore intended that the claims be interpreted in accordance with the true spirit and scope of the invention without limitation or estoppel.

What is claimed is:

1. A system for mounting tactical attachments to a firearm having an ammunition tube and an ammunition spring mounted therein, said system comprising:

a tactical attachment adapter, said tactical attachment adapter having an ammunition tube mounting end and an opposing tactical attachment mounting end, said ammunition tube mounting end removably mounted to an end of said ammunition tube of said firearm, said tactical attachment mounting end having a cavity fashioned therein, said tactical attachment mounting end having one or more pins extending into said cavity; and a tactical attachment, said tactical attachment having a mounting structure, said mounting structure having one or more "J" shaped slots fashioned within an outer surface, said mounting structure being inserted into said cavity fashioned within said tactical attachment mounting end of said tactical attachment adapter such that said one or more pins extending into said cavity are engaged within a hook portion of said one or more "J" shaped slots, wherein said tactical attachment adapter has a bore fashioned therein, said bore extending from said ammunition tube mounting end to said cavity, said bore having a piston inserted therein, said piston having a first surface in contact with said outer surface of said tactical attachment mounting structure, said piston having a second opposing surface in contact with said ammunition spring.

2. The system as recited in claim 1, wherein said tactical attachment is a flashlight.

3. The system as recited in claim 1, wherein said flashlight has an on/off switch engaged by a rotary collar with detent positions.

4. The system as recited in claim 3, wherein said flashlight comprises a built in stun gun.

5. The system as recited in claim 1, wherein said tactical attachment is a laser illuminated sight.

6. The system as recited in claim 5, wherein said laser illuminated sight has an on/off switch engaged by a rotary collar with detent positions.

7. A system for mounting tactical attachments to a firearm having an ammunition tube and an ammunition spring mounted therein, said system comprising:

a tactical attachment adapter, said tactical attachment adapter having an ammunition tube mounting end and an opposing tactical attachment mounting end, said ammunition tube mounting end removably mounted to an end of said ammunition tube of said firearm, said tactical attachment mounting end having a cavity fashioned therein, said tactical attachment mounting end having one or more "J" shaped slots fashioned within a surface of said cavity; and a tactical attachment, said tactical attachment having a mounting structure, said mounting structure having a first portion and a second portion, said first portion of said mounting structure having one or more pins extending from an outer surface, said first portion of said mounting structure being inserted into said cavity fashioned within said tactical attachment mounting end of said tactical attachment adapter such that said one or more pins extending from said outer surface of said tactical attachment are engaged within a hook portion of said one or more "J" shaped slots, said second portion of said tactical attachment mounting structure comprising a locking ring, said locking ring engaging an external threaded surface on said second portion of said tactical attachment mounting structure, said locking ring operative to provide tension between said tactical attachment and said tactical attachment adapter.

8. The system as recited in claim 7, wherein said tactical attachment adapter has a bore fashioned therein, said bore extending from said ammunition tube mounting end to said cavity, said bore having a piston inserted therein, said piston having a first surface in contact with said outer surface of said first portion of said tactical attachment mounting structure, said piston having a second opposing surface in contact with said ammunition spring.

9. The system as recited in claim 8, wherein said tactical attachment is a flashlight.

10. The system as recited in claim 9, wherein said flashlight has an on/off switch engaged by a rotary collar with detent positions.

11. The system as recited in claim 10, wherein said flashlight comprises a built in stun gun.

12. The system as recited in claim 8, wherein said tactical attachment is a laser illuminated sight.

13. The system as recited in claim 12, wherein said laser illuminated sight has an on/off switch engaged by a rotary collar with detent positions.

14. The system as recited in claim 7, wherein said tactical attachment adapter has a bore fashioned therein, said bore extending from said ammunition tube mounting end to said cavity, said ammunition spring extending through said bore.

15. The system as recited in claim 14, wherein said tactical attachment is a breaching tool, said ammunition spring extending within an internal volume of said breaching tool.

16. The system as recited in claim 14, wherein said tactical attachment is an ammunition capacity extension tube, said ammunition spring extending within an internal volume of said ammunition capacity extension tube.

17. A system for mounting tactical attachments to a firearm having an ammunition tube and an ammunition spring mounted therein, said system comprising:

a tactical attachment adapter, said tactical attachment adapter having an ammunition tube mounting end and an opposing tactical attachment mounting end, said ammunition tube mounting end removably mounted to an end of said ammunition tube of said firearm, said tactical attachment mounting end having a cavity fashioned therein, said tactical attachment mounting end having one or more "J" shaped slots fashioned within a surface of said cavity; and a tactical attachment, said tactical attachment having a mounting structure, said mounting structure having one or more pins extending from an outer surface, said mounting structure being inserted into said cavity fashioned within said tactical attachment mounting end of said tactical attachment adapter such that said one or more pins extending from said outer surface of said tactical attachment are engaged within a hook portion of said one or more "J" shaped slots, wherein said tactical attachment adapter has a bore fashioned therein, said bore extending from said ammunition tube mounting end to said cavity, said bore having a piston inserted therein, said piston having a first surface in contact with said outer surface of said tactical attachment mounting structure, said piston having a second opposing surface in contact with said ammunition spring.

18. The system as recited in claim 17, wherein said tactical attachment is a flashlight.

19. The system as recited in claim 17, wherein said flashlight has an on/off switch engaged by a rotary collar with detent positions.

20. The system as recited in claim 17, wherein said tactical attachment is a laser illuminated sight.

* * * * *